US005813456A

United States Patent [19]

Milner et al.

[11] Patent Number: 5,813,456

[45] Date of Patent: Sep. 29, 1998

[54] RETRIEVABLE BRIDGE PLUG AND RETRIEVING TOOL

[76] Inventors: John E. Milner, 6313 Wilshire Dr., Tyler, Tex. 75703; David L. Farley, 415 Woodvale Ave., Lafayette, La. 70503

[21] Appl. No.: 746,468

[22] Filed: Nov. 12, 1996

[51] Int. Cl.[6] ..... E21B 33/128

[52] U.S. Cl. ..... 166/135; 166/386

[58] Field of Search ..... 166/133, 134, 166/135, 123, 120, 126, 129, 386

[56] References Cited

U.S. PATENT DOCUMENTS

| | | | |
|---|---|---|---|
| 4,149,594 | 4/1979 | Evans | 166/134 |
| 4,156,460 | 5/1979 | Crowe | 166/120 |
| 4,432,418 | 2/1984 | Mayland | 166/133 |
| 4,898,239 | 2/1990 | Rosenthal | 166/133 |
| 4,898,245 | 2/1990 | Braddick | 166/387 |
| 5,029,643 | 7/1991 | Winslow et al. | 166/131 |
| 5,058,684 | 10/1991 | Winslow et al. | 166/386 |
| 5,074,361 | 12/1991 | Brico et al. | 166/301 |
| 5,103,902 | 4/1992 | Ross et al. | 166/120 |
| 5,273,109 | 12/1993 | Arizmendi et al. | 166/123 |
| 5,318,117 | 6/1994 | Echols, III et al. | 166/114 |
| 5,333,685 | 8/1994 | Gilbert | 166/123 |
| 5,390,737 | 2/1995 | Jacobi et al. | 166/184 |
| 5,441,111 | 8/1995 | Whiteford | 166/387 |

*Primary Examiner*—Frank Tsay
*Attorney, Agent, or Firm*—Pravel, Hewitt & Kimball

[57] ABSTRACT

A retrievable bridge plug apparatus and retrieving tool, the retrievable bridge plug apparatus serving as a temporary bridge plug that can be set in casing in order to isolate the zone and aiding in the stimulation of the zone or test which would be conducted within the zone. The apparatus would include mechanical slips and compression type sealing packer rubbers with a mechanically operated J-slot for locking it in the running position or the set position. Further, the packer rubbers would be of sufficient size for allowing an annulus between the packer body and the wall of the casing for running and bypassing fluid as it travels in and out of the well, yet are sufficiently close tolerance to the casing for preventing extrusion when set and can be exposed to high differential pressure. There is further provided an equalizing valve for assuring equalization of pressure before the tool is released and providing additional area for bypassing fluid travelling in and out of the well for faster running of the tool in and out of the casing. It is further provided a running tool which would prevent the accidental loss of the bridge plug and threaded connections in the packer mandrel by permitting right or left hand torque to be applied.

12 Claims, 6 Drawing Sheets

RETRIEVABLE BRIDGE PLUG AND RETRIEVING TOOL

BACKGROUND OF THE INVENTION

1. Field of the Invention

The apparatus of the present invention relates to bridge plugs and retrieving tools therefor. Further, the present invention relates to a retrievable bridge plug for use in downhole casing or tubing, particularly in the area of high pressure packer type bridge plugs for zone treating and testing, utilizing an internal bypass for equalizing pressure and preventing swabbing effects.

2. General Background of the Invention

In the petroleum industry, normally in the area of completion or workover, retrievable bridge plugs are utilized often for temporarily isolating a zone and maintaining differential pressure downhole. In the utilization of bridge plugs, the plugs are usually run down the borehole utilizing a running tool to the desired depth down the borehole. Normally the plug would then be set using tubing. By utilizing a plug in this manner, there is formed a barrier at a predetermined point downhole, whereby a certain depth within downhole could be isolated and there could then be formed a different pressure differential for testing that area. The plug would then be retrieved from the casing by the retrieving tool, so that further work down the borehole could be undertaken in the normal manner.

The plugs in the present state of the art lack certain features which would be vital in the operation of such apparatus. For example, plugs being lowered downhole usually meet resistance of fluid within the hole, and therefore, the bypass of the fluid through and around the plug would help to assist the movement of the plug downhole during the process of situating the plug within the borehole. Further, after the plug has been set, and the work has been undertaken and the zone isolated by the plug, often times debris of foreign material will become lodged on the upper part of the plug which could hinder or cause failure of the operation of the slips. Therefore, in order to overcome this, it would be important to include a feature in the plug which would allow an ability to clean the area around the slips while the plug is situated downhole, so that operation of the slips are guaranteed. Furthermore, one of the failures of bridge plugs often includes the fact that the bridge plug when it is retrieved from downhole, may be accidentally lost from the connection between the bridge plug and retrieving tool. Such failure would be catastrophic in that the bridge plug may be irretrievable down the borehole or valuable rig time would be lost in attempting to retrieve the plug that has been lost from the end of the retrieving tool. Also, in the operation of the tool, it may be necessary to turn the packer mandrel left or right so it is important to provide a design that permits this without the danger of breaking a thread, yet still allowing it to be easily disassembled when needed.

BRIEF SUMMARY OF THE INVENTION

The apparatus of the present invention solves the problems in a simple and straight forward manner. What is provided is a retrievable bridge plug apparatus and retrieving tool, the retrievable bridge plug apparatus serving as a temporary bridge plug that can be set in casing in order to isolate the zone and aiding in the stimulation of the zone or test which would be conducted within the zone. The apparatus would include mechanical slips and compression type sealing packer rubbers with a mechanically operated J-slot for locking it in the running position or the set position.

Further, the packer rubbers would be of sufficient size for allowing an annulus between the packer body and the wall of the casing for running and bypassing fluid as it travels in and out of the well, yet are sufficiently close tolerance to the casing for preventing extrusion when set and can be exposed to high differential pressure. There is further provided an equalizing valve for assuring equalization of pressure before the tool is released and providing additional area for bypassing fluid travelling in and out of the well for faster running of the tool in and out of the casing. Further, there is provided a flow system for allowing fluid to be circulated through the bridge plug so that the circulated fluid may come into contact with the upper slips of the plug and wash away any debris which has accumulated on the slips so that the slips may be operable when the plug is retrieved from the hole.

Therefore, it is the principal object of the present invention to provide a retrievable bridge plug apparatus that may be set in casing for isolating a zone yet allowing the bypass of fluid between the body of the plug and the casing wall during lowering or retrieving the plug from the well.

It is a further object of the present invention to provide a retrievable bridge plug which while allowing fluid to bypass the plug as it travels in and out the well, prevents extrusion when set and when it is exposed to high differential pressure within the well.

It is a further object of the present invention to provide a retrievable bridge plug which has an equalizing valve for providing equalization of pressure before the tool is released and for providing additional area for bypassing fluid travelling in and out of the well.

It is a further object of the present invention to provide a bridge plug which has a design for aiding in the cleaning of sand or debris from the bridge plug by allowing circulation through the center of the pulling head and inner mandrel down to ports below the upper slips, which results in removal of debris which may prevent the upper slips from releasing.

It is a further object of the present invention to provide a retrievable bridge plug apparatus for isolating a zone down a bore hole which includes upper and lower turnbuckle couplings on the mandrel body having left and right hand threads which include lugs that engage one another, for permitting left and right hand torque to be applied through these connections without the danger of the connections accidentally being loosened or to become unthreaded.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote like elements and wherein.

Figure 5:
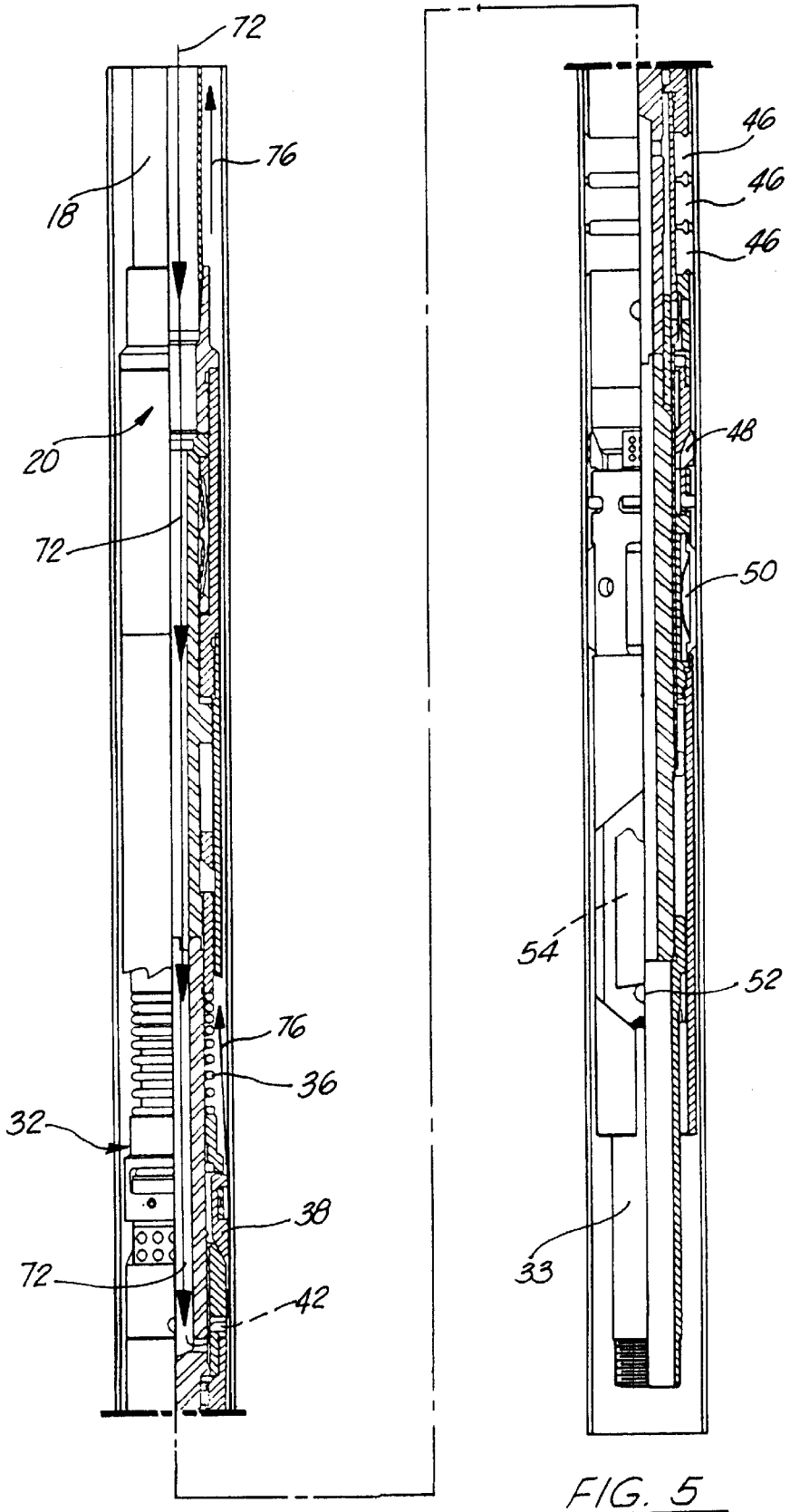
Figure 6:
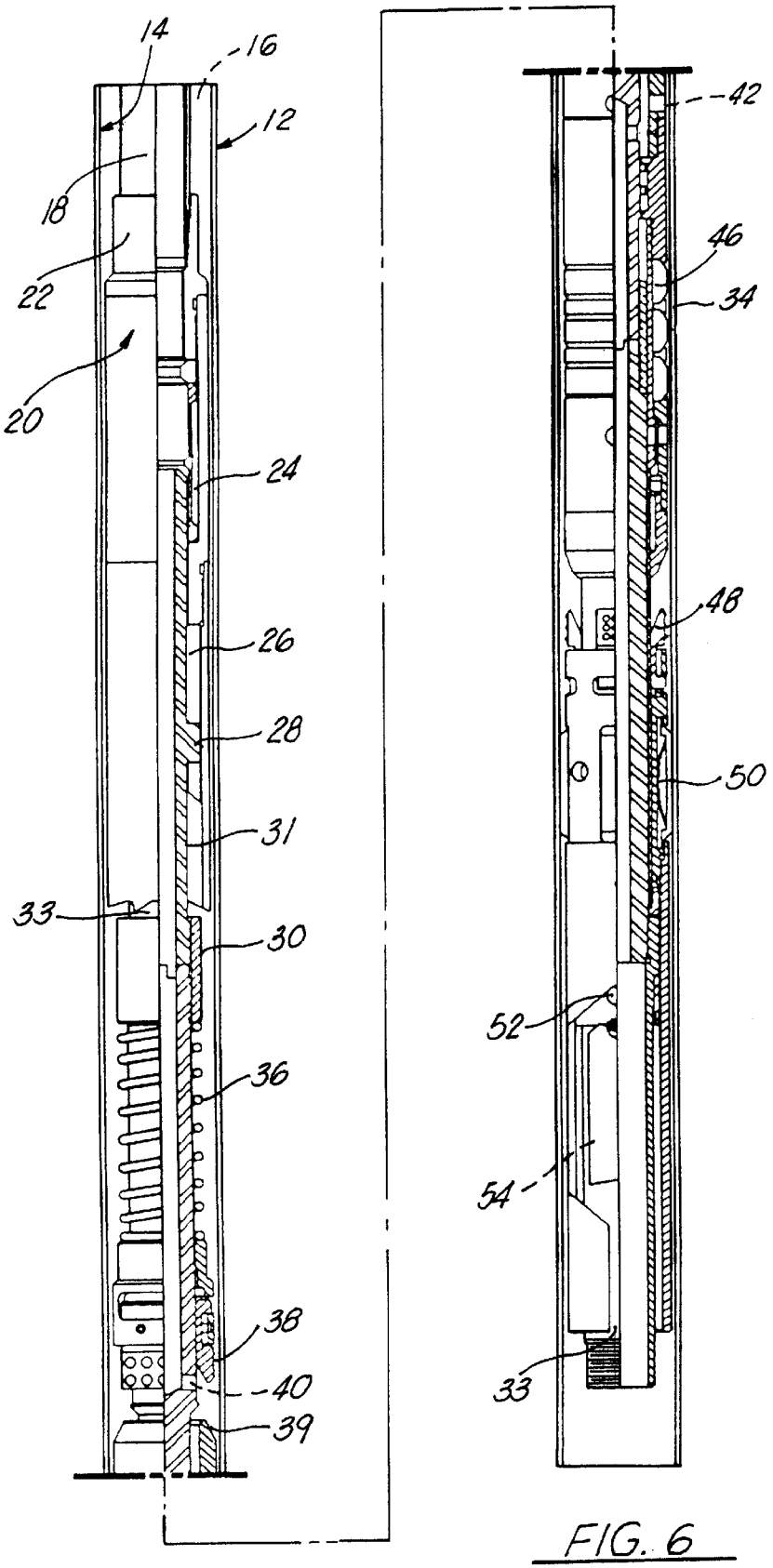

FIG. 5 is an overall view of the retrievable bridge plug apparatus which has fluid circulating therethrough for removal of debris prior to retrieving the bridge plug from the hole; and FIG. 6 is an overall view of the retrievable bridge plug apparatus within the borehole reattached to the retrieving tool and being retrieved from the borehole after the slips have been released and the rubber elements retracted.

DETAILED DESCRIPTION OF THE INVENTION

Figure 1:
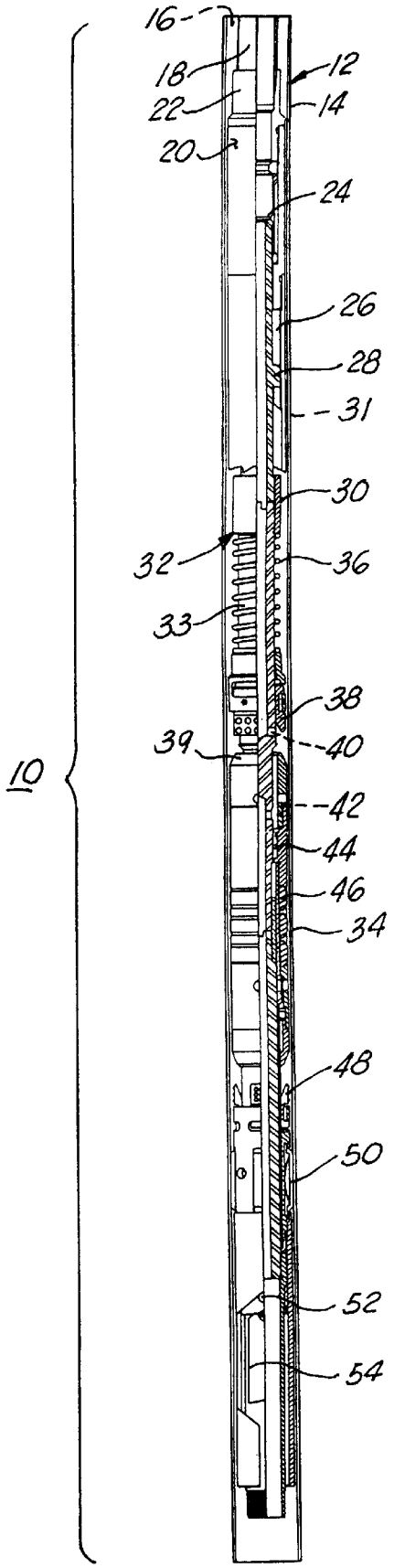
FIG. 1 is an overall view of the retrievable bridge plug apparatus and running tool lowered within a casing.

FIGS. 1–6 illustrate the preferred embodiment of the apparatus of the present invention by the numeral 10. As illustrated in the FIGURES, FIGS. 1–6 illustrate a sequential arrangement of views of the retrievable bridge plug apparatus secured or unsecured to the retrieving tool, as it is lowered downhole, set in place, and released in order to be retrieved from downhole. As illustrated in overall view in FIG. 1, there is illustrated the overall combination of the retrievable bridge plug apparatus engaged to the retrieving tool, the overall combination illustrated by the numeral 10. As illustrated, the combination 10 is set within a continuous string casing 12 which has a continuous side wall 14 and a hollow bore 16 through which the apparatus 10 is positioned there within. As illustrated in FIG. 1, there is illustrated the string of tubing 18 threadably secured to the upper portion of a retrieving tool or overshot 20 which is defined by an upper collar portion 22, having a collet member 24, the running tool including a J slot 26 engaging lugs 28, which are positioned on the pulling head 31 of an inner mandrel 33 of the bridge plug apparatus 32. The J slot 26 would engage lugs 28 in a locking position, which would be dictated by the mechanical movement of the string of tubing 18 during the engagement process. The turnbuckle coupling 30 is fixed on an inner mandrel, where the upper turnbuckle coupling 30 and the lower turn buckle coupling 34 provided with a right and left hand thread. The turn buckle couplings 30, 34 hold two male threads together which are right and left hand threads, which have the lugs 26 that engage each other. With this type of engagement with the turn buckle couplings 30, 34, there is permitted left or right hand torque to be applied to these connections without the danger of the couplings accidentally being loosened or becoming unthreaded. When the connections need to be loosened for repair of the tool, the turnbuckle couplings 30, 34, are easily disconnected by rotation of the turn buckle. Such rotation would separate the two male threads, disengaging the lugs 28 and permitting the connection to be disassembled. In this manner, no special fitting of parts are required, and furthermore, the parts are interchangeable.

As further illustrated, the bridge plug 32 is provided with a spring member 36, upper slips 38, circulating ports 40, with bypass or equalizing ports 42 in the open position as seen in FIG. 1. There is further provided seals 44 and rubber elements 46, the function of which will be described further. Furthermore, there is a set of lower slips 48, drag blocks 50 and a lower set of lugs 52 and a lower J slot 54. These elements work in conjunction as will be described further in the lowering of the tool downhole, setting the tool, circulating fluid through the tool and retrieving the tool when work within the BORE 16 by the bridge plug is completed.

Figure 2:
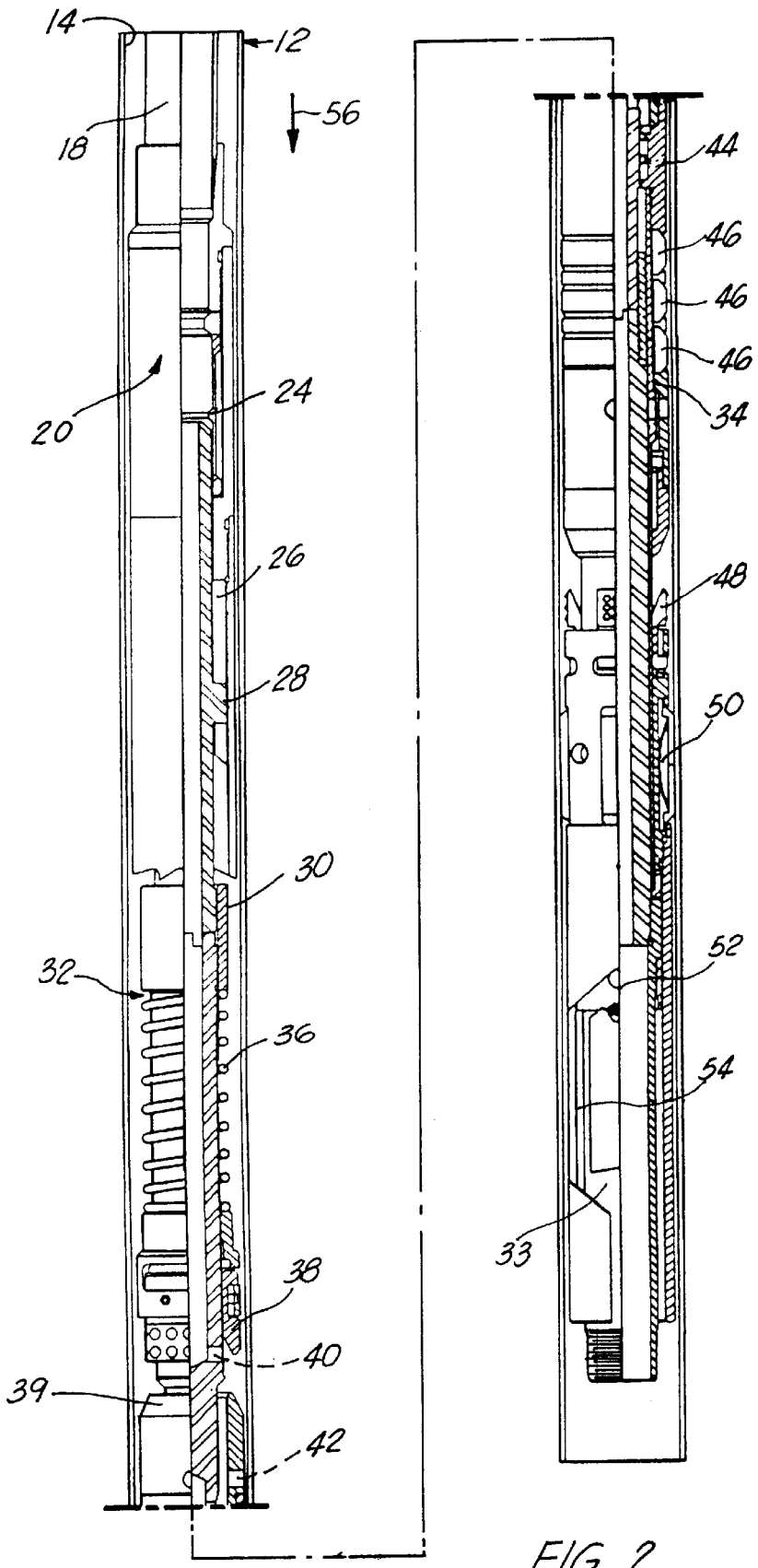
FIG. 2 is an overall view of the bridge plug apparatus and running tool being lowered into the well at the end of a string of tubing.

As seen in FIG. 2 in overall view, the bridge plug is being lowered into the well in the direction of arrow 56, which again what is seen the tubing 18 threadably engaged onto the running tool or overshot 20 wherein the J slot 26 has engaged the pulling head 31 of the bridge plug 32 and is lowering it downhole, with the upper slips 38 disengaged, and likewise the lower slips 48 disengaged, with the rubber elements 46 in the retracted mode and the drag blocks 50 likewise in the retracted mode, so that the overall outer diameter of the tool 32 is sufficiently less than the inner diameter of the wall 14 of the casing 12, so that there is no contact as the tool is being lowered downhole. Likewise, it should be noted that the circulating ports 40 and the bypass/equalizing ports 42 are in the opened position so that any fluid contained within the bore 16 of the casing 12 flows through the tool as the tool is being lowered down the cased well.

Making reference particularly to the contact between the overshot or retrieving tool 20, and the retrievable bridge plug apparatus 32, the retrieving tool 20 is designed so that the J slot 26 as seen in FIG. 2, engages the pulling head 31 of the retrievable bridge plug apparatus 32 by a mechanical movement of the tubing 18. It is important that the connection between the overshot or retrieving tool 20 and the retrievable bridge plug 32 require considerable force in order to disengage, so that there is no accidental disengagement between the tools. In order to overcome the force that has engaged the J slot 26 and the running tool 20 to the retrievable bridge plug 32, a special collet 24 is included, which itself requires force to overcome. This force is achieved by using the weight of the tubing 18 which allows the movement necessary to disengage the overshot 20 from the retrievable bridge plug 32. The collet 24 is a superior mechanism to a spring, for example, since a spring does not reach its maximum force until considerable travel and compression would take place. The collet 24 on the other hand gives maximum resistance initially and offers maximum assurance that the lugs 28 on the pulling head 31 will not move out of its locked position of the J slot 26 while the tool 32 is being run in and out of the wellbore.

Another feature of the tool is the fact that prior to running the tool 32 down the hole as seen in FIG. 2, the bridge plug apparatus 32 can be assembled utilizing either a right or left hand J slot 28. The over shot or retrieving tool 20 would normally be assembled with a J slot 28 which requires torque to release opposite in the direction of torque for unsetting the bridge plug 32. As can be understood, this is done so as to prevent accidental release of the bridge plug 32 while one is removing the over shot 20 from the bridge plug connection.

Figure 3:
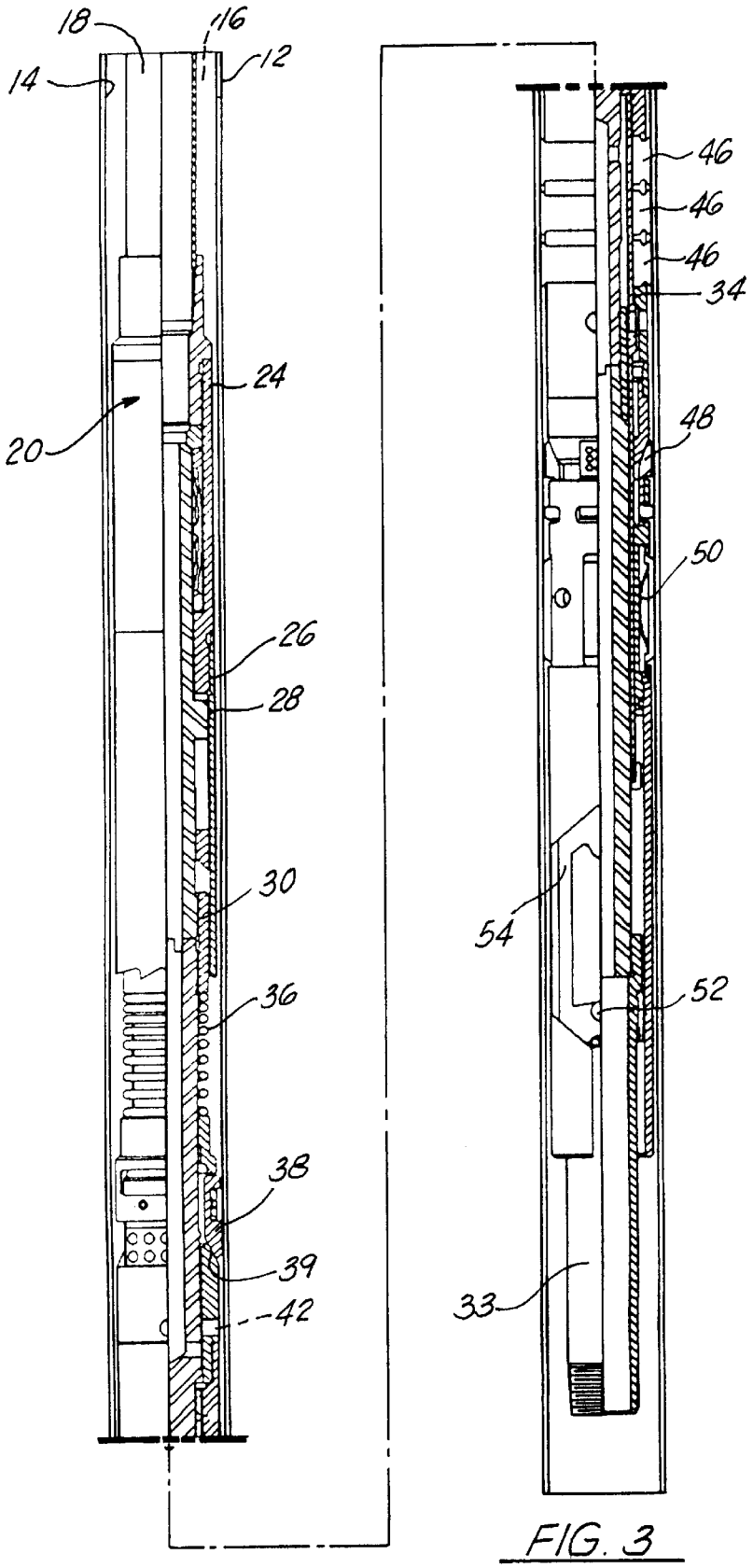
FIG. 3 is an overall view of the retrievable bridge plug apparatus and running tool within the casing in the process of setting the bridge plug apparatus.
Figure 4:
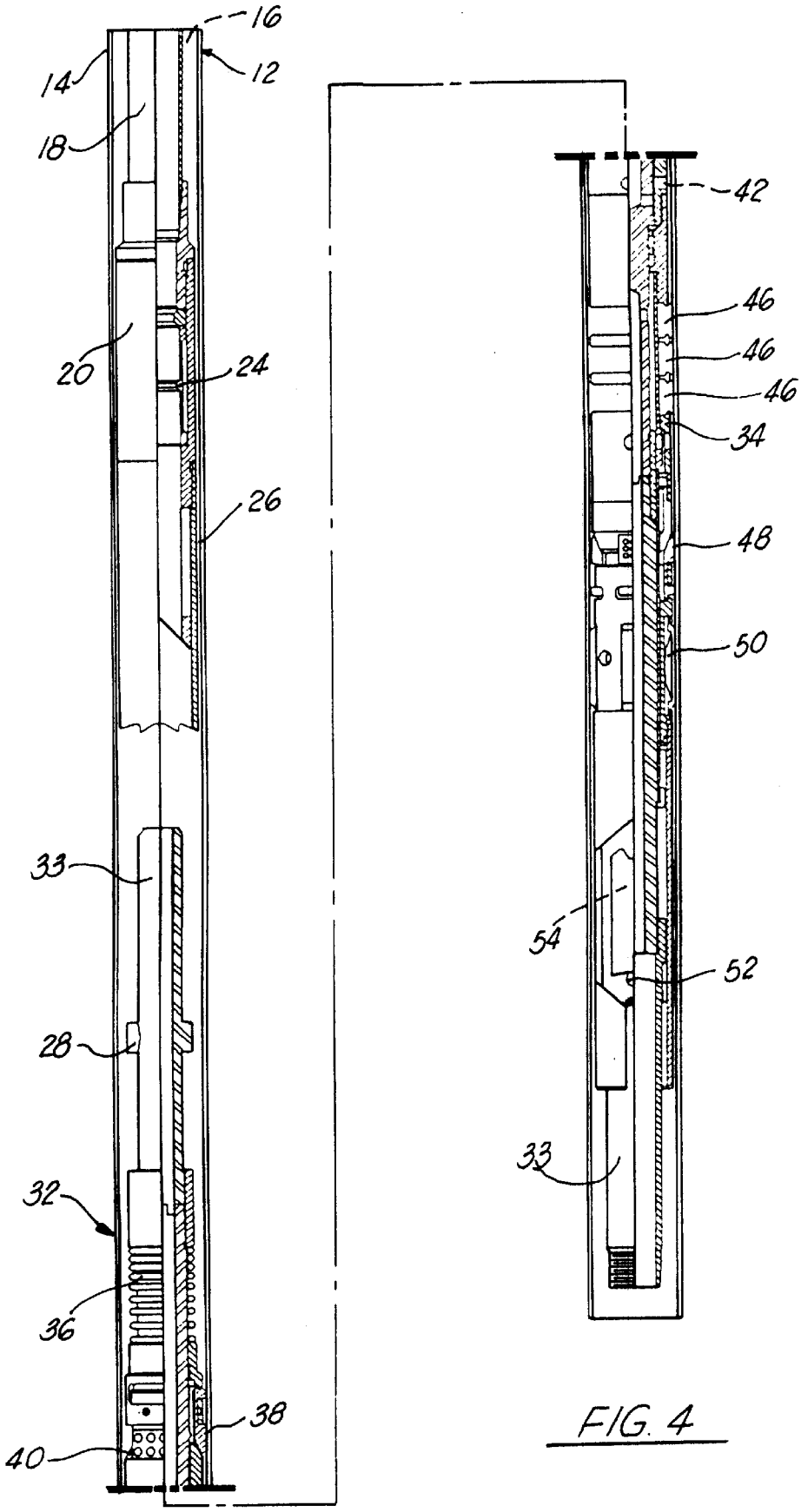
FIG. 4 is an overall view of the retrievable bridge plug apparatus set within the hole and released from the running tool.

Reference is now made to FIG. 3 which illustrates the bridge plug apparatus 32 being set within the borehole. As seen in FIG. 3, the bridge plug apparatus 32 has been lowered to the predetermined depth within the borehole where the sealing must occur. When the retrievable bridge plug 32 is in position, it is set against the wall 14 of the tubing 12, by applying the necessary torque and by lowering the tubing 18 in the hole. This lowering of the tubing 18 will cause the lugs 28 on the lower end of the inner mandrel 33 to disengage from the running position of the J slot 26, and will present the lower slips 48 to be expanded by the lower cone 60 and in expanding same, wedging the slips 48 against the wall 14 of the casing 12. After the lower slips 48 have engaged the casing 12, the tubing weight would force the upper slips 38 on the upper cone 39 to expand which would likewise expand the upper slips 38 against the casing as illustrated in FIG. 3. This movement would close the equalizing valve 42, and place the lugs 28 on the inner mandrel 33 in the lower locked position of the J slot 26. At this point, additional weight would be applied to compress the packer rubbers 46 which would effect the seal between the rubbers 46 and the casing 12, and wedge the upper and lower slips 38, 48 in place. If necessary, tension can be applied to set the bridge plug 32 tighter before releasing the running tool 20. In order to release the over shot or retrieving tool 20 from the bridge plug, sufficient weight will overcome the collet 34, torque would be applied and the tubing can be raised from the hole as illustrated in FIG. 4. As seen in this FIGURE, the retrieving tool 20 is being pulled from the hole in the direction of arrow 70, and the retrievable bridge plug 32 is set in place within the hole with the upper and lower slips 38, 48, engaging the wall of the casing 12 and the rubbers 46 are expanded against the wall of the casing to effect the necessary seal.

At this point in the process, reference is made to FIG. 5, where the retrievable bridge plug 32 is set in place, and a zone above or below the bridge plug 32 has been tested or stimulated as the case may be. At this point in the process, the over shot or retrieving tool 20 may be reengaged to the pulling head 36 of the bridge plug apparatus 32 in order to move or to retrieve the bridge plug apparatus 32 from the borehole. At this point in the process, also it is common that one would expect sand and/or debris to be settled on the bridge plug apparatus. Therefore, it may be necessary to achieve a circulation through the bridge plug 32 in order to remove this material from the upper portion or top of the tool 32 while lowering the over shot or retrieving tool 20 to reengage the upper end of the bridge plug apparatus 32. The bridge plug apparatus 32 would include a means for aiding in this cleaning process by allowing circulation of fluid to take place through the center of the pulling head 31 and through the inner mandrel 33, down to ports below the upper slips 38. This circulation of the fluid is indicated by the arrow 72 which as seen in FIG. 5 moves in the down direction, then would flow through the bypass or equalizing ports 42 up through the annulus 76 between the wall of the bridge plug 32 and the wall 14 of the casing 12 and up through the annulus above the bridge plug 32 as indicated by arrow 78. In this manner, by circulating through the bypass/equalizing ports 42 below the upper slips 38, removal of material that may cause damage or may prevent the upper slips 38 from releasing is achieved, and serves as a means for insuring that the upper slips 38 will operate when it is necessary to retrieve the bridge plug apparatus 32 from the borehole.

It should be noted that the circulation as indicated by arrows 72, 76 in FIG. 5 may be established by either down the tubing 18 and up the casing 12 as illustrated, or may be achieved in the other direction, i.e. down the casing wall 14 and up the tubing 18. The point of the circulation as was stated earlier is to achieve a cleaning of the top of the bridge plug apparatus 32, so that the slips will disengage from the wall 14 of the casing 12, and the bridge plug apparatus 32 may be removed.

In order to release the bridge plug from its position as set in FIG. 5, where fluid has been circulated, reference is now made to FIG. 6 where the tubing 18 with the retrieving tool 20 is lowered onto the tool 32 and tubing weight is applied to overcome the resistance of the collet 24 in the overshot or retrieving tool 20, so that the lugs 28 can be relocked into J slot 26. Applying torque to unlock the lugs 28 in the bridge plug 32 and pulling on the tubing 18 will release the bridge plug 32. That is, the spring 36 will be reexpanded and the upper slips 38 will be released from contact with the casing wall 14, the rubber elements 42 will be retracted from contact with the wall of the casing 12 and additional pulling will release the lower slips 48 from the wall of the casing 12 so that the apparatus is no longer making contact between itself and the wall of the casing 12. It should be kept in mind that the bridge plug pulling head 31 cannot be disengaged accidentally since considerable weight must be applied to overcome the resistance of the collet 24. This would insure that the bridge plug 32 would have to be intentionally reset before sufficient weight could be applied to release from it. This safety feature is critical in assuring that the bridge plug will not be dropped accidentally when it is being pulled loose from the wall of the casing 12 or when it is being retrieved from the well.

PARTS LIST

The following is a list of suitable parts and materials for the various elements of the preferred embodiment of the present invention.

| Description | Part No. |
|---|---|
| bridge plug and retrieving tool combination | 10 |
| casing | 12 |
| side wall | 14 |
| bore | 16 |
| tubing | 18 |
| retrieving tool or overshot | 20 |
| upper collar portion | 22 |
| collet | 24 |
| J slot | 26 |
| lugs | 28 |
| upper turnbuckle coupling | 30 |
| pulling head | 31 |
| bridge plug apparatus | 32 |
| inner mandrel | 33 |
| lower turnbuckle coupling | 34 |
| spring member | 36 |
| upper slips | 38 |
| upper cone | 39 |
| circulating ports | 40 |
| equailzing ports | 42 |
| seals | 44 |
| rubber elements | 46 |
| lower slips | 48 |
| drag blocks | 50 |
| lower set of lugs | 52 |
| lower J slot | 54 |
| arrow | 56 |
| lower cone | 60 |
| arrows | 72, 76, 78 |

The foregoing embodiments are presented by way of example only; the scope of the present invention is to be limited only by the following claims.

We claim:

1. A retrievable bridge plug apparatus for isolating a zone down a borehole, comprising:

a) a mandrel body portion;

b) a retrieving tool secured to an upper portion of the mandrel body;

c) expandable members on upper and lower ends of the mandrel body portion moveable to sealingly engage against the wall of a casing when sufficient weight is brought to bear on the mandrel body portion;

d) flow ports in the mandrel body for allowing fluid circulation through the apparatus for cleaning the expandable members prior to disengagement from the casing; and e) means for disengaging the expandable members on the mandrel body from against the casing wall, so that the tool may be retrieved from the borehole.

2. The bridge plug apparatus in claim 1, wherein the apparatus is secured to the retrieving tool with lugs on the apparatus secured into a J-slot on the retrieving tool.

3. The bridge plug apparatus in claim 1, wherein there is further provided upper and lower turnbuckle couplings on the mandrel body having a left and right hand threads.

4. The apparatus in claim 1 wherein the retrieving tool is engaged and disengaged from the apparatus through the use of the weight of tubing above the retrieving tool.

5. The apparatus in claim 1 wherein the expandable members further comprise upper and lower slips and expandable rubber members against the wall of the casing.

6. A retrievable bridge plug apparatus for isolating a zone down a borehole, comprising:

a) a mandrel body portion having left and right threaded connections on end portions of the mandrel body portion;

b) a retrieving tool attached to the lower end of a string of tubing and secured to the upper portion of the mandrel body;

c) slip members on upper and lower ends of the mandrel body portion moveable to sealingly engage against the wall of casing when sufficient weight is brought to bear on the mandrel body portion by lowering the tubing string;

d) flow ports in the mandrel body for allowing fluid circulation through the tool for cleaning the slip members prior to disengagement from the casing; and e) means for disengaging the slip members on the mandrel body from against the casing wall by the movement of the tubing string, so that the tool may be retrieved from the borehole.

7. The bridge plug apparatus in claim 6, wherein the apparatus is secured to the retrieving tool with lugs on the apparatus secured into a J-slot on the retrieving tool.

8. The bridge plug apparatus in claim 6, wherein there is further provided upper and lower turnbuckle couplings on the mandrel body having a left and right hand threads.

9. The apparatus in claim 6, wherein the retrieving tool is engaged and disengaged from the apparatus through the use of the weight of the tubing above the retrieving tool.

10. The apparatus in claim 6, wherein the expandable members further comprise upper and lower slips and expandable rubber members against the wall of the casing.

11. A method of setting and retrieving a bridge plug apparatus in a borehole, comprising the following steps:

a) providing a bridge plug and lowering the bridge plug down a cased borehole from a retrieving tool;

b) applying sufficient weight on the bridge plug for engaging a set of lower slips against the wall of the casing;

c) applying additional force on the bridge plug for engaging a set of upper slips against the wall of the casing;

d) causing rubber members to expand against the wall of the casing so as to effect a fluid seal between the bridge plug and the casing;

e) allowing fluid to circulate through the bridge plug for cleaning any foreign material from the upper slips;

f) reattaching the retrieving tool to the bridge plug;

g) disengaging the upper and lower slips from the casing;

h) allowing the rubber elements to retract from against the wall of the casing;

i) pulling the bridge plug from the hole with the retrieving tool.

12. The method in claim 11, wherein there is provided the step of equalizing the pressure above and below the bridge plug before the plug is released.

* * * * *